US012618327B2

(12) United States Patent
Tamminen et al.

(10) Patent No.: US 12,618,327 B2
(45) Date of Patent: May 5, 2026

(54) SENSOR SYSTEM OF UNDERGROUND MINING VEHICLES AND UNDERGROUND MINING VEHICLE COMPRISING SENSOR SYSTEM

(71) Applicant: Sandvik Mining and Construction Oy, Tampere (FI)

(72) Inventors: Pekka Tamminen, Tampere (FI); Jussi Tuominen, Tampere (FI); Jani Saarinen, Tampere (FI); Juha Hoffren, Tampere (FI); Hannu Helen, Tampere (FI); Mikko Huurre, Tampere (FI); Marko Vuokila, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 113 days.

(21) Appl. No.: 18/836,453

(22) PCT Filed: Feb. 3, 2023

(86) PCT No.: PCT/EP2023/052621
§ 371 (c)(1),
(2) Date: Aug. 7, 2024

(87) PCT Pub. No.: WO2023/152030
PCT Pub. Date: Aug. 17, 2023

(65) Prior Publication Data

US 2025/0129719 A1 Apr. 24, 2025

(30) Foreign Application Priority Data

Feb. 11, 2022 (EP) ..... 22156249

(51) Int. Cl.
*E21C 35/00* (2006.01)
*E21C 35/04* (2006.01)

(52) U.S. Cl.
CPC ..... *E21C 35/04* (2013.01)

(58) Field of Classification Search
CPC . B60R 21/0136; E21C 35/282; E21C 35/302; E21C 35/04; E21C 35/10;
(Continued)

(56) References Cited

U.S. PATENT DOCUMENTS 3,861,488 A 1/1975 Hamada et al.
4,189,183 A 2/1980 Borowski
(Continued)

FOREIGN PATENT DOCUMENTS

CN 201730617 U 2/2011
GB 2489590 A 10/2012

OTHER PUBLICATIONS

Hesselbach et al., "Automatised positioning of an underground drilling vessel", Automatisierungstechnische Praxis, 37 (1995) XP000511027 (with English abstract).
(Continued)

*Primary Examiner* — Toan C To
(74) *Attorney, Agent, or Firm* — Morgan, Lewis & Bockius LLP

(57) ABSTRACT

A sensor system of underground mining vehicles, which system is arranged to be fastened at a perimeter of an underground mining vehicle, comprising a sensor (1) and a stand (2), wherein the stand comprises a mounting plate (3) for fastening the stand (2) to the underground mining vehicle, a movable plate (4) fastened moveably to the mounting plate (3), a guard member (7*a*, 7*b*, . . . ) fastened to the movable plate (4), and a biasing member (9*a*, 9*b*, . . . ) fastened between the movable plate (4) and the mounting plate (3). The sensor (1) is fastened to the movable plate (4). The movable plate (4) has two positions: a resting position, and a retracted position, and the biasing member
(Continued)

(9*a*, 9*b*, . . . ) is biasing the movable plate (4) to the resting position.

15 Claims, 5 Drawing Sheets

(58) Field of Classification Search
CPC . G01B 7/26; E21B 47/01; E21F 17/18; E21D 9/003; A47F 1/126
See application file for complete search history.

(56) References Cited

U.S. PATENT DOCUMENTS 6,253,557 B1 * 7/2001 Credle, Jr. ..... F25D 21/02 62/139
6,370,952 B1 * 4/2002 Little ..... G01F 23/04 73/304 R
6,553,925 B1 * 4/2003 Beaujot ..... A01C 5/06 180/401
11,678,600 B2 * 6/2023 Koch ..... A01C 5/068 172/4
11,711,994 B2 * 8/2023 Forbes ..... A01B 63/245 172/1
11,802,756 B2 * 10/2023 Weeres ..... G01B 7/06
12,279,546 B2 * 4/2025 Swanson ..... A01C 5/064
2020/0371234 A1 * 11/2020 Smith ..... G02B 1/14
2022/0373317 A1 * 11/2022 Swanson ..... G01B 7/26

OTHER PUBLICATIONS

International Search Report and Written Opinion dated Mar. 9, 2023, issued in corresponding International Patent Application No. PCT/EP2023/052621.

* cited by examiner

SENSOR SYSTEM OF UNDERGROUND MINING VEHICLES AND UNDERGROUND MINING VEHICLE COMPRISING SENSOR SYSTEM

TECHNICAL FIELD

The present invention relates to sensor systems of underground mining vehicles and underground mining vehicles comprising a sensor system.

BACKGROUND OF THE ART

Underground mining vehicles operate in harsh conditions undergrounds where is dark, roads are narrow, and the road network is constantly changing. Due to poor visibility, it is hard to see people, other machines or any other obstacles, e.g. loose rocks, on the road and the underground mining vehicle may be damaged if it runs into an obstacle. Further, the underground mining vehicles are big, and the operator's view from the cab is therefore restricted. Especially right next to the underground mining vehicle. Therefore, underground mining vehicles may comprise sensors to help the operator to see or be aware of the surroundings of the vehicle. Even if the underground mining vehicle has sensors, it is still possible to hit obstacles on the road or walls or ceiling of the mine. Due the collision, the sensors may break or at least their position may change, and they may be useless after the collision.

OBJECTIVE OF THE INVENTION

The objective of the system is to alleviate the disadvantages mentioned above. In particular, it is an objective of the present system to provide a sensor system of underground mining vehicles that protects the sensor from impacts, i.e. external forces subjected to the sensor system, while providing better visibility of the surroundings of the underground mining vehicle.

SUMMARY

According to a first aspect, the present invention provides a system for protecting a sensor fastened to the underground mining vehicle.

The sensor system of underground mining vehicles, which system is arranged to be fastened at a perimeter of an underground mining vehicle, comprising a sensor and a stand, wherein the stand comprises a mounting plate for fastening the stand to the underground mining vehicle; a movable plate, having an inner end and an outer end, fastened moveably to the mounting plate; a guard member comprising a rim, which guard member is provided at the outer end so that the rim extends over the outer end of the movable plate; and a biasing member fastened between the movable plate and the mounting plate. The sensor is fastened to the movable plate so that the sensor is between the rim of the guard member and the inner end of the movable plate. The movable plate has two positions: a resting position, wherein the rim of the guard member is extending outside of the underground vehicle perimeter when the system is fastened to the underground mining vehicle, and a retracted position, wherein the outer end and the sensor are retracted inside the perimeter of the underground mining vehicle when the system is fastened to the underground mining vehicle, and the biasing member is biasing the movable plate to the resting position.

The advantage of the system is that the underground mining vehicle operator has better visibility and/or understanding of the surroundings of the vehicle as the system may be fastened to the underground mining vehicle so that the sensor is outside of the perimeter of the vehicle while the sensor is protected from external impacts.

According to an embodiment of the system, the sensor is outside the perimeter of the underground mining vehicle when the movable plate is in the resting position.

According to an embodiment of the system, the biasing member is a mechanical spring.

According to an embodiment of the system, the biasing member is made of rubber.

According to an embodiment of the system, the biasing member comprises a hydraulic cylinder or a pneumatic cylinder.

According to an embodiment of the system, the guard member is a wheel fastened to the movable plate with an axle perpendicular to the movable plate.

According to an embodiment of the system, the movable plate is arranged to move linearly between the resting position and the retracted position on top of the mounting plate.

According to an embodiment of the system, the movable plate comprises at least two sections, a first section being parallel to the mounting plate, and a second section being perpendicular to the first section.

According to an embodiment of the system, the movable plate comprises a third section, which is parallel to the first section, and the second section is arranged between the first section and the third section.

According to an embodiment of the system, the mounting plate comprises a perpendicular part, and the biasing member is arranged between the perpendicular part and the second section of the movable plate.

According to an embodiment of the system, the stand comprises guiding means for guiding the movement of the movable plate between the resting position and the retracted position.

According to an embodiment of the system, the guiding means comprises at least one elongated opening in the mounting plate and fastening means for fastening the movable plate to the mounting plate, wherein the fastening means are configured to extend from the movable plate through the at least one elongated opening.

According to an embodiment of the system, the guiding means comprises an elongated rod extending from the second section of the movable plate and a hole in the perpendicular part of the mounting plate, wherein the elongated rod extends from the second section through the hole in the perpendicular part.

According to an embodiment of the system, the movable plate, together with the guard member and the sensor fastened to the movable plate, is arranged to move towards the retracted position when the rim is subjected to an external force exceeding the biasing force of the biasing member.

According to a second aspect, the present invention provides as underground mining vehicle comprising a sensor system described herein.

It is to be understood that the aspects and embodiments of the invention described above may be used in any combination with each other. Several of the aspects and embodiments may be combined together to form a further embodiment of the invention.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION

Figure 1:
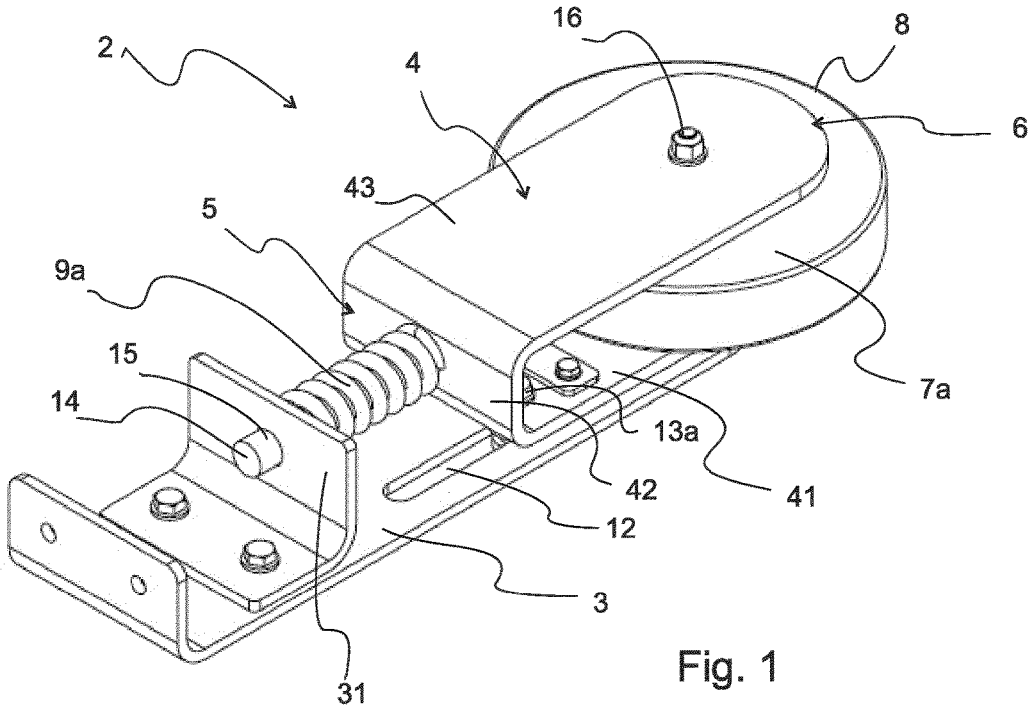
FIG. 1 shows a sensor system according to the invention.

The system described herein is an sensor system of underground mining vehicles. The underground mining vehicle may be a mine machine or a construction machine e.g. a rock drilling rig, a development drill, a tunneling drilling machine, a surface drilling machine, a bolting or reinforcing vehicle, a rock removal machine, a long hole drill rig, an explosive charging machine, a loader, a transport vehicle, a loading machine, or hauling machine, setting vehicle of gallery arcs or nets, a concrete spraying machine, a crusher, a measuring vehicle, a passenger transport vehicle, or a loading or a hauling machine. The common feature for all these vehicles is that they are designed to operate in harsh conditions underground, wherein the road network is continuously changing. In the following chapters, term vehicle is used but it should be understood as an underground mining vehicle described herein.

The sensor system, comprising a sensor 1 and a stand 2, is configured to be fastened to the underground mining vehicle at, i.e. in close proximity, a perimeter of the underground mining vehicle so that the system extends over the perimeter of the vehicle, i.e. the outer edge of the system is outside of the perimeter of the vehicle and inner edge of the system is inside the perimeter of the vehicle. Consequently, the sensor 1 may extend over the perimeter of the vehicle and, therefore, provide unrestricted visibility around the vehicle. To protect the sensor from external impacts, the system comprises also a guard member 7*a*, 7*b*, . . . , which extends further outside the perimeter of the vehicle than the sensor, when the system is fastened to the vehicle.

For example, the system may be fastened to a fender of the vehicle. The fender may be for example front or rear bumber, or it may be a wheel fender.

The stand 2 of the sensor system comprises a mounting plate 3 for fastening the stand 2 to the vehicle, a movable plate 4 fastened moveably to the mounting plate 3, a guard member 7*a*, 7*b*, . . . at the outer end of the movable plate 4, and a biasing member 9*a*, 9*b*, . . . fastened between the movable plate 4 and the mounting plate 3. Fastened between the movable plate and the mounting plate should be understood as fastened to the biasing member is fastened to the movable plate and the mounting plate so, that the biasing member is able to act between these components, i.e. the plates may subject forces to the biasing member and vice versa.

The movable plate 4 has an inner end 5, which is the end towards the center of the vehicle when the system is fastened to the vehicle, and an outer end 6, which is opposite to the inner end 5. The guard member 7*a*, 7*b*, . . . comprises a rim 8, which is pointing outwards of the vehicle, when the system is fastened to the vehicle. The movable plate 4 may be a thin plate, bended plate, or any part which may be fastened to the mounting plate 3.

The guard member 7*a*, 7*b*, . . . is provided at the outer end of the movable plate 4, i.e. it is in proximity to the outer end 6 so that the rim 8 extends over the outer end 6 of the movable plate 4. The guard member may be fastened to the movable plate or it may be integral part of the movable plate. The fastening point of the guard member depends on the size of the guard member. Therefore, the proximity to the outer end means that the fastening point of the guard member is closer to the outer end than the inner end of the movable plate.

The biasing member 9*a*, 9*b*, . . . is fastened between the movable plate 4 and the mounting plate 3. The biasing member 9*a*, 9*b*, . . . may be any means capable of being extended, compressed or pivoted to provide the force for biasing the movable plate relative to the mounting plate. Examples of suitable biasing member would include various springs such as mechanical springs, e.g. coiled, coil compression, spiral, retractable, leaf or torsion spring, pneumatic cylinder/piston arrangements, lengths of resilient material such as rubber or other elastic material, etc.

The movable plate 4 has two positions: a resting position, wherein the rim 8 of the guard member 7*a*, 7*b*, . . . is extending outside of the underground vehicle perimeter when the system is fastened to the underground mining vehicle, and a retracted position, wherein the outer end 6 of the movable plate 4 and the sensor 1 are retracted inside the perimeter of the underground mining vehicle when the system is fastened to the underground mining vehicle. In normal situation, the movable plate 4 is in resting position and the rim 8 of the guard member is outside of the perimeter of the vehicle. If the guard member 7*a*, 7*b*, . . . is subjected to an external force, e.g. a collision with a loose rock or a wall of the mine, the movable plate 7 and the components attached to it would move towards the retracted position. Naturally, the external force should exceed the biasing force of the biasing member to move the movable plate towards or to the retracted position. When the external force is not applied anymore, the biasing force of the biasing member will bias, i.e. push, the movable plate back to the resting position.

The following chapters defines different kind of embodiments of the system. Especially, they define different embodiments of the parts or components in the system. The different embodiments may be applied to the system separately or together with other embodiments described herein even if the different optional structures are not described in each embodiment. E.g. different kinds of guard members, biasing members may be applied to any embodiments described herein. Also, any kind of structure of movable plate and/or mounting plate may be applied to any embodiments described herein.

The sensor 1 of the system may be for example a vision-based sensor, e.g. camera or other machine vision-based sensor, a scanner, or a radar. The sensor may be located outside of the perimeter of the vehicle, when the system is fastened to the vehicle and the movable plate is in resting position.

The guard member may be a wheel 7*a* rotatable around an axis perpendicular to the movement of the movable plate; a fixed block 7*b*, e.g. made of non-elastic or elastic material, such as rubber, which may have a curved rim; or a section of the movable plate forming outer edge of the movable plate.

The movable plate 4 may move linearly between the resting position and the retracted position on top of the mounting plate, i.e. moving along a straight line. Optionally, the movement may be non-linear, e.g. rotational.

The movable plate 4 may comprise a first section 41, which is parallel to the mounting plate 3. All components fastened to the movable plate 4 may be fastened to the first section 41. The first section 41 of the movable plate is moveably fastened to the mounting plate 3. Additionally, the movable plate 4 may comprise a second section 42, that is perpendicular to the first section 41. Some of the components of the system may be fastened to the first section 41 and some of the components may be fastened to the second section 42. For example, the sensor 1 and the guard member 7*a*, 7*b*, . . . may be fastened to the first section 41, and the biasing member 9*a*, 9*b*, . . . may be fastened to the second section 42. Optionally, all the components are fastened to the first section 41. Additionally, the movable plate 4 may comprise a third section 43, which is parallel to the first section 41, and the second section 42 is between the first section 41 and the third section 43, i.e. the movable plate is a U-shaped plate. The guard member 7*a*, 7*b*, . . . may be fastened between the first section 41 and the third section 43.

The mounting plate 3 is for example an elongated plate having a first surface, on which the movable plate 4 is fastened, a second surface on the opposite side of the plate, long sides, and short sides. The second surface of the mounting plate is the mounting surface which is fastened to the vehicle. However, the mounting plate may be fastened to the vehicle with fastening means that may be fastened to the first surface. The mounting plate 3 may comprise a perpendicular part 31, which may be a bended section or a separate perpendicular part. The biasing member 9*a*, 9*b*, . . . may be fastened between the perpendicular part 31 and the movable plate 4, e.g. the second section 42 of the movable plate. The perpendicular part 31 may comprise a hole 15, which is used for guiding the movement of the movable plate 4.

The system may comprise guiding means 12, 13(*a*, *b*, . . . ), 14, 15 for guiding the movement of the movable plate 4. The guiding means may comprise at least one opening 12 in the mounting plate 3, fastening means 13*a*, 13*b*, . . . for fastening the movable plate 4 to the mounting plate 3, and/or a rod 14 extending from the movable plate through the hole 15 in the perpendicular part 31 of the mounting plate 3. The opening 12 may be elongated opening or openings arranged in parallel direction to the long sides of the mounting plate. The mounting plate 3 may comprise more than one opening. The fastening means may comprise at least one pin, bolt or screw 13*a*, that extends from the movable plate 4 through at least one opening 12 in the mounting plate 3. The pin may comprise threads. The movable plate 4, e.g. the first section 41, may comprise opening and the pin, bolt or screw 13*a* is provided through the opening on the movable plate and the opening 12 in the mounting plate. The pin, bolt or screw 13*a* may comprise a head and a nut 13*b*, wherein the nut is fastened to the other end of the pin, bolt, or screw, and the movable plate and the mounting plate are arranged between the head and the nut. By tightening the nut 13*b* to the threads of the pin, bolt or screw, the movable plate 4 and the mounting plate 3 are pressed towards each other. Instead of head, the pin, bolt or screw may comprise another nut in the other end. The fastening means may comprise two or more pins, bolts or screws, and the mounting plate comprises the same number of openings through which the pins, bolts, or screws are fastened. There may be a washer or washers in conjunction with the pin, bolt or screw so that the washer(s) are between the movable plate and the mounting plate. Optionally or additionally, washers may be provided in conjunction with the pin, bolt, or screw so that the washers are between the head of the pin, bolt or screw and the movable plate and/or between the nut and the mounting plate.

FIG. 1 shows an embodiment of the stand 2 of the sensor system. The stand comprises a mounting plate 3 and a movable plate 4 fastened moveably to the mounting plate 3.

The mounting plate 3 is an elongated sheet, which may be made of metal. The mounting plate 3 comprises a base section comprising the surface to which the movable plate 4 is fastened. The mounting plate 3 comprises a perpendicular part 31 which is perpendicular to the base section. The perpendicular part 31 is a separate component fastened to the base section. The separate perpendicular part 31 is fastened to the mounting plate 3 by bolts, but optionally, it may be fastened by welding or adhesive or other mechanical means.

The movable plate 4 is an elongated sheet, which is fastened to the mounting plate 3 moveably, i.e. the movable plate 4 is fastened to the mounting plate 3 but it may move in relation to the mounting plate 3. The movable plate 4 comprises a first section 41, that is parallel to the base section of the mounting plate 3, a second section 42 perpendicular to the first section 41, and a third section 43 parallel to the first section 41. The second section 42 is between the first section 41 and third section 43.

The stand 2 comprises a guard member fastened to the movable plate. The guard member in embodiment of FIG. 1 is a wheel 7*a*, which is rotatable about an axle 16 perpendicular to the movable plate 4. The wheel 7*a* is fastened between the first section 41 and the third section 43 of the movable plate by the axle 16. The wheel 7*a* comprises a rim 8, which is defined by perimeter of the wheel 7*a*.

The stand 2 comprises a biasing member between the movable plate 4 and the mounting plate 3. In FIG. 1, the biasing member is a coiled spring 9*a* arranged between the perpendicular part 31 of the mounting plate and the second section 42 of the movable plate, whereby the coiled spring 9*a* is biasing the movable plate 4 to the resting position. If the rim 8 of the wheel 7*a* is subjected to an external force that exceeds the biasing force of the coiled spring 9*a*, the movable plate 4 retracts towards the retracted position, i.e. towards the perpendicular part 31 of the mounting plate.

The stand 2 comprises guiding means for guiding the movement of the movable plate 4. The guiding means in FIG. 1 comprises two elongated openings 12 in base section of the mounting plate 3. The movable plate 4 is fastened to the openings 12 in the mounting plate with fastening means so that the movable plate 4 is movable along the elongated openings. The fastening means comprises bolts 13*a* and nuts 13*b* (seen in FIG. 2). The bolts are fastened through the first section 41 of the movable plate and through the elongated openings 12 in the mounting plate. The nuts 13*b* are fastened to the bolts so that the movable plate and mounting plate are squeezed towards each other by the screw head and nut. The elongated openings 12 define a path which the movable plate may move in relation to the mounting plate. In FIG. 1, the elongated openings are linear, and the movable plate 4 moves linearly along these openings 12 between the resting position and the retracted position. The guiding means comprises also an elongated rod 14, which is extending from the second section 42 of the movable plate 4. The perpendicular part 31 comprises a hole 15, and the rod 14 is extending through the hole 15. The coiled spring 9*a* is arranged coaxially around the elongated rod 14 so that the elongated rod runs through the coiled spring 9*a*, whereby the elongated rod 14 supports the coiled spring 9*a*.

Figure 2:
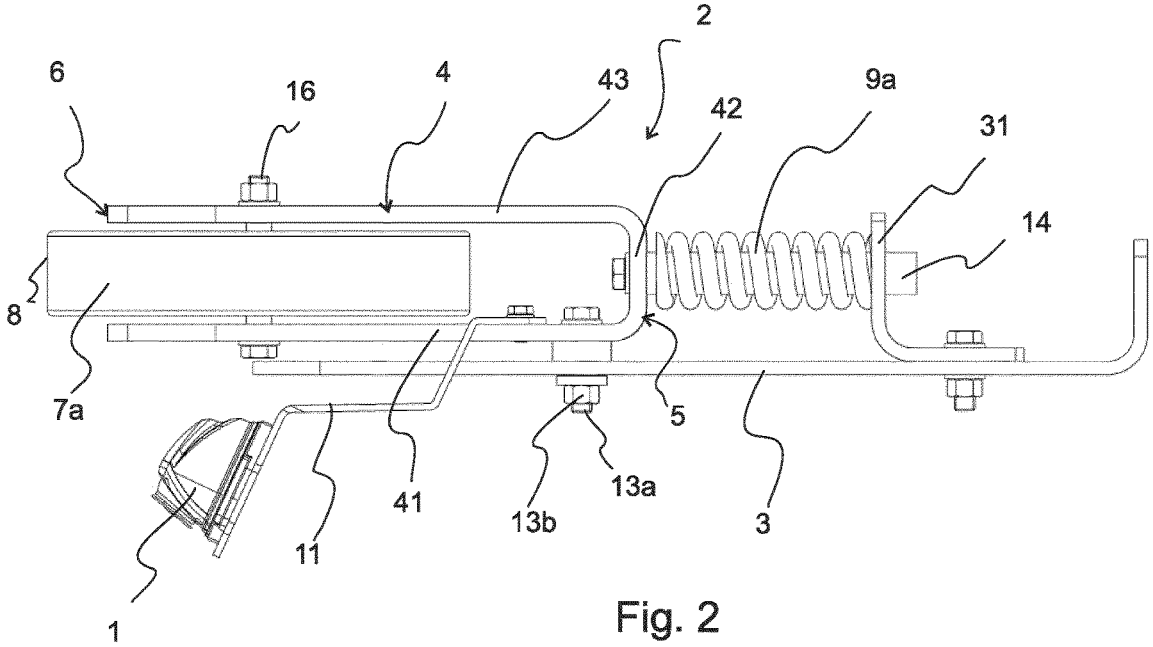
FIG. 2 shows a side view of the system of FIG. 1.

FIG. 2 shows a side view of the stand 2 shown in FIG. 1, wherein a sensor 1 is fastened to the movable plate 4. The sensor 1 is located between the rim 8 of the wheel 7*a* and the inner end 5 of the movable plate 4. By such location, the rim 8 of the guard member, i.e. wheel 7*a*, protects the sensor 1 from external forces, such as impacts of obstacles. The sensor 1 is fastened to the first section 41 of the movable plate 4 by a fastening part, which in FIG. 2 is a bended sheet 11. The bended sheet may be for example metal sheet.

Figure 3:
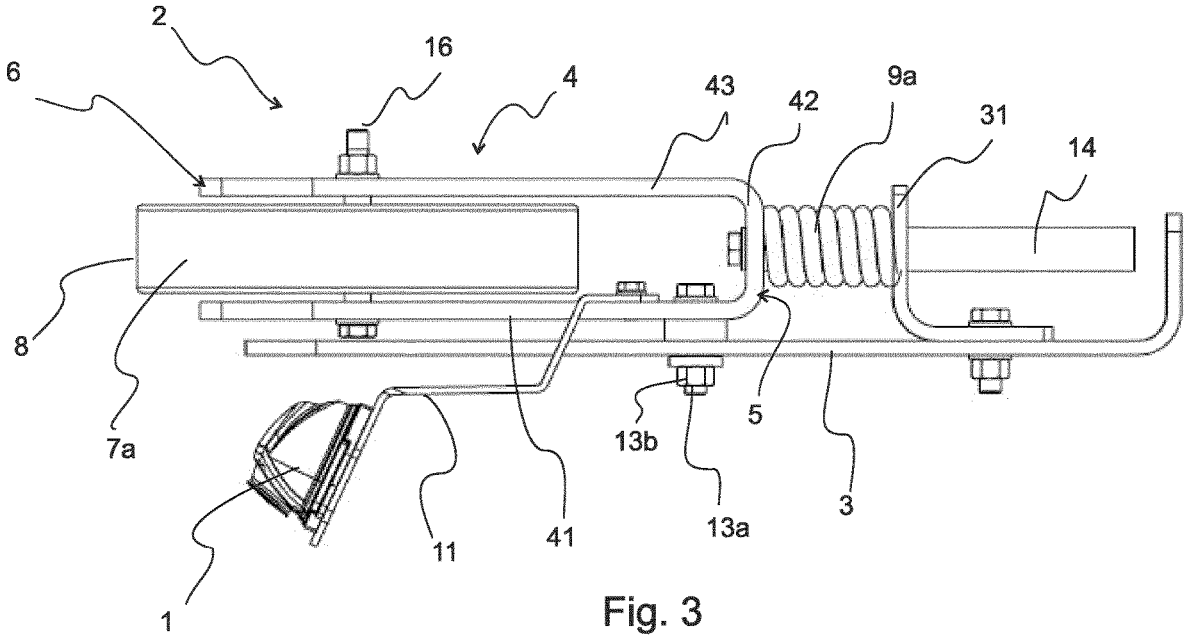
FIG. 3 shows the system of FIG. 2, but the movable plate is in retracted position.

FIG. 3 shows the system of FIG. 2 but the movable plate 4 is in retracted position, i.e. the biasing member, i.e. the coiled spring 9*a*, is compressed and the movable plate 4 is retracted towards the perpendicular part 31 of the mounting plate 3.

Figure 4:
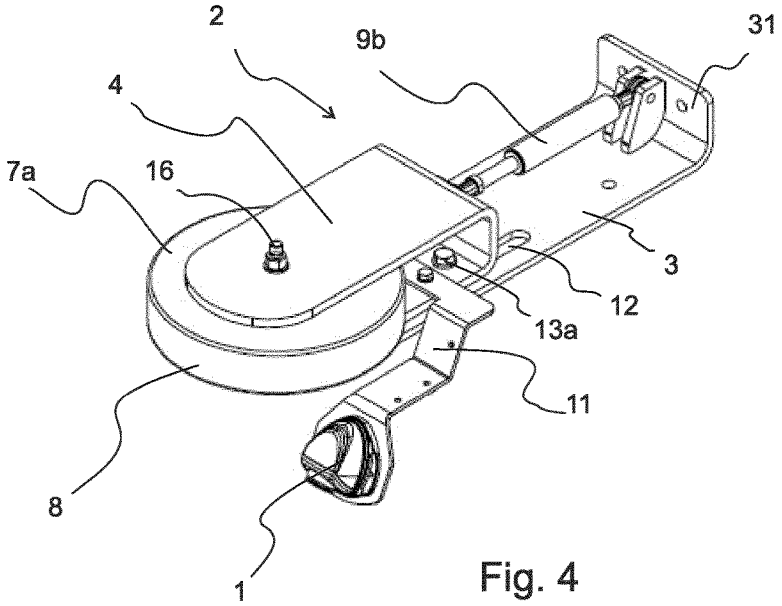
FIG. 4 shows an embodiment, wherein the biasing member comprises a pneumatic cylinder.

FIG. 4 shows an embodiment, wherein the biasing member comprises a pneumatic cylinder 9*b*, which is fastened between the mounting plate 3 and the movable plate 4. The mounting plate 3 comprises a perpendicular section 31 and the pneumatic cylinder 9*b* is fastened to the perpendicular section 31. The guard member is a wheel 7*a*, which is fastened to the movable plate 4 via perpendicular axle 16 so that the wheel 7*a* is rotatable about the perpendicular axle 16. Instead of pneumatic cylinder 9*a*, the biasing member may comprise hydraulic cylinder.

Figure 5A:
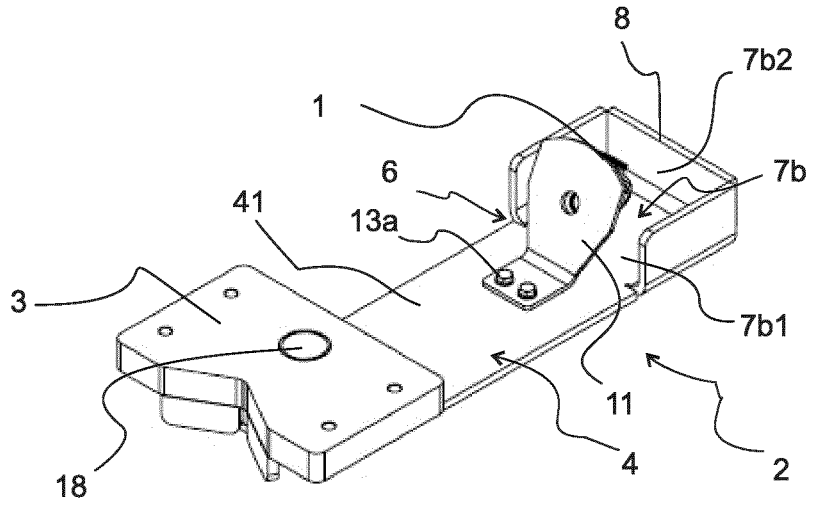
FIG. 5*a* shows an embodiment, wherein the movable plate is pivotally movable.
Figure 5B:
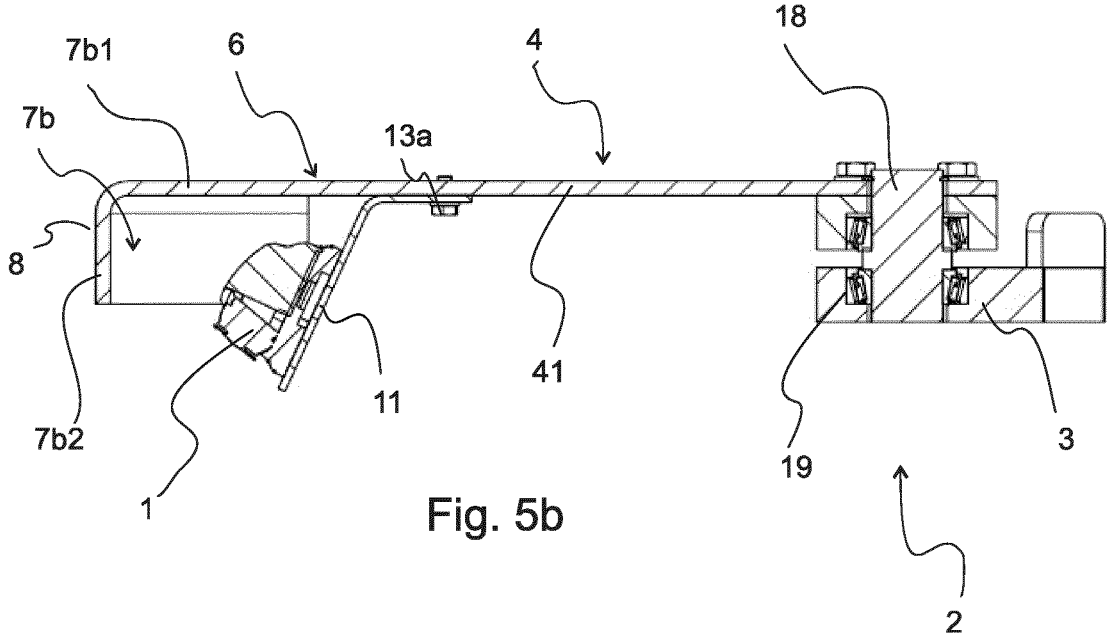
FIG. 5*b* is a sectional view of embodiment of FIG. 5*a*.

FIG. 5*a* shows an embodiment, wherein the movable plate 4 is fastened to the mounting plate 3 with an axle 18 so that the movable plate 4 may rotate about the axle 18. FIG. 5*b* is a sectional side view of the embodiment. The movable plate 4 comprises a first section 41 and a guard section 7*b*, which is at the outer end 6 of the movable plate 4, comprising a parallel section 7*b*1, which is parallel to the first section 41, and a perpendicular section 7*b*2 being perpendicular to the first section 41 and parallel section 7*b*1. The guard section 7*b* is the guard member in this embodiment. The perpendicular section 7*b*2 of the guard section may be bended from the parallel section 7*b*1, or it may be fastened to the parallel section e.g. by welding. The perpendicular section 7*b*1 forms the rim 8 of the guard member. The parallel section 7*b*1 may be extension to the first section, i.e. uniform structure, or it may be fastened to the first section by fastening means, e.g. screws or bolts. A bearing or bearings 19 may be provided between the axle 18 and the movable plate 4 and/or between the axle 18 and the mounting plate 3. The biasing member may be for example a spiral spring (not shown in figure), which is fastened between the mounting plate 3 and the movable plate 4 to bias the movable plate 4 to the resting position. When the guard member, i.e. the guard section 7*b*2, is subjected to an external force, the movable plate 4 rotates about the axle 18 to the retracted position. In FIGS. 5*a* and 5*b*, the movable plate is in resting position.

Figure 6:
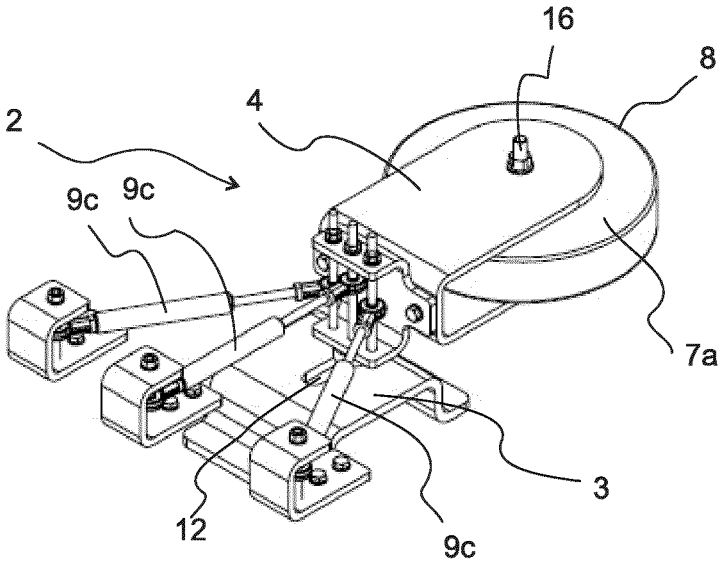
FIG. 6 shows an embodiment, wherein the biasing member comprises three pneumatic cylinders.

FIG. 6 shows an embodiment, wherein the biasing member comprises three pneumatic cylinders 9*c* between the movable plate and the mounting plate. The pneumatic cylinders 9*c* may be in parallel plane, or in separate planes which are essentially parallel to each other. The fastening points of the cylinders in mounting plate and fastening points in the movable plate are located at a distance to each other so that they form a triangle shape. The distance between adjacent fastening points in mounting plate is greater than the distance between adjacent fastening points in movable plate. Thus, the three cylinders are fastened to the mounting plate so that they allow both rotational and linear movement of the movable plate. The guard member in these figures is a wheel 7*a* but it may be any kind of guard member described herein. Instead of pneumatic cylinders 9*c*, the biasing member may comprise hydraulic cylinders.

Figure 7A:
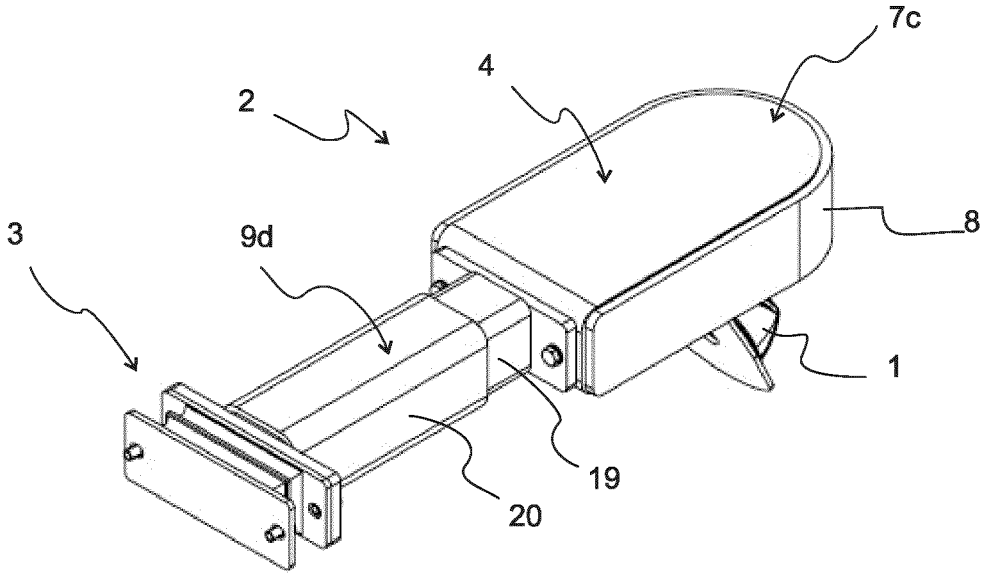
FIG. 7*a* shows an embodiment, wherein the biasing member comprises a coiled spring and a first housing.
Figure 7B:
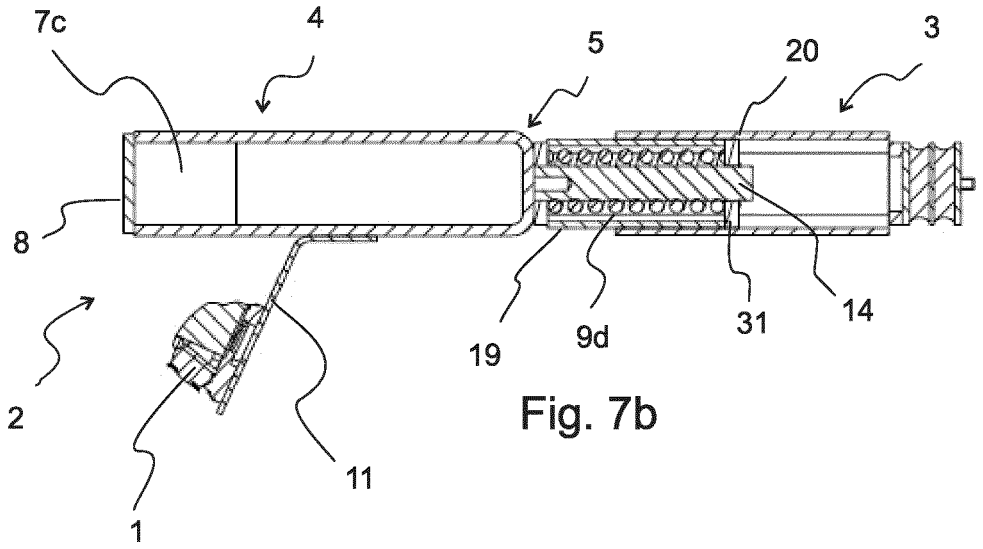
FIG. 7*b* is a sectional view of embodiment of FIG. 7*a*.

FIG. 7*a* shows an embodiment, wherein the biasing member comprises a coiled spring 9*d* and a first housing 19, and the mounting plate 3 comprises a second housing 20 and a perpendicular part 31. The perpendicular part 31 is an annular ring extending radially towards the center axis of the second housing 20. The perpendicular part 31 may be separate part fastened to the second housing 20, e.g. by welding, or it may be bended section of the second housing 20. FIG. 7*b* shows a cross section of the same embodiment. The first housing 19 and second housing 20 are arranged coaxially so that the first housing is inside the second housing. The first housing 19 is fastened to the movable plate 4 and configured to move in axial direction so that the movable plate 4 may move between resting position and retracted position. The movable plate 4 is made of sheet, e.g. made of metal, which is bended to form enclosed capsule. The coiled spring 9*d* is arranged coaxially inside the first housing 19, and is arranged between the movable plate 4 and the perpendicular part 31 of the second housing, i.e. mounting plate 3. The coiled spring 9*d* may be fixed to the movable plate 4 and/or perpendicular part 31, or it may be arranged freely, i.e. not fixed to the movable plate 4 or the perpendicular part 31. The guard member 7*c* at the outer end of the movable plate is an integral part of the enclosed capsule. The stand comprises an elongated rod 14, which is arranged coaxially inside the coiled spring 9*d*, and the rod 14 is extending from the movable plate 4 through an opening in the perpendicular part 31. The rim of the guard member 7*c* is curved (in horizontal plane), but optionally, it may have different shapes.

Although the invention has been the described in conjunction with a certain type of system, it should be understood that the invention is not limited to any certain type of system. While the present inventions have been described in connection with a number of exemplary embodiments, and implementations, the present inventions are not so limited, but rather cover various modifications, and equivalent arrangements, which fall within the purview of prospective claims.

The invention claimed is:

1. A sensor system for an underground mining vehicle, which system is arranged to be fastened at a perimeter of the underground mining vehicle, comprising a sensor and a stand, wherein the stand comprises:

a mounting plate for fastening the stand to the underground mining vehicle, a movable plate, having an inner end and an outer end, fastened moveably to the mounting plate, a guard member comprising a rim, which guard member is provided at the outer end so that the rim extends over the outer end of the movable plate, and a biasing member fastened between the movable plate and the mounting plate;

wherein the sensor is fastened to the movable plate so that the sensor is between the rim of the guard member and the inner end of the movable plate, wherein the movable plate has two positions:

a resting position, wherein the rim of the guard member is extending outside of the underground vehicle perimeter when the system is fastened to the underground mining vehicle, and a retracted position, wherein the outer end and the sensor are retracted inside the perimeter of the underground mining vehicle when the system is fastened to the underground mining vehicle, and wherein the biasing member is biasing the movable plate to the resting position.

2. The sensor system for an underground mining vehicle according to claim 1, wherein the sensor is outside the perimeter of the underground mining vehicle when the movable plate is in the resting position.

3. The sensor system for an underground mining vehicle according to claim 1, wherein the biasing member is a mechanical spring.

4. The sensor system for an underground mining vehicle according to claim 1, wherein the biasing member is made of rubber.

5. The sensor system for an underground mining vehicle according to claim 1, wherein the biasing member comprises a hydraulic cylinder or a pneumatic cylinder.

6. The sensor system for an underground mining vehicle according to claim 1, wherein the guard member is a wheel fastened to the movable plate with an axle perpendicular to the movable plate.

7. The sensor system for an underground mining vehicle according to claim 1, wherein the movable plate is arranged to move linearly between the resting position and the retracted position on top of the mounting plate.

8. The sensor system for an underground mining vehicle according to claim 1, wherein the movable plate comprises at least two sections, a first section being parallel to the mounting plate, and a second section being perpendicular to the first section.

9. The sensor system for an underground mining vehicle according to claim 8, wherein the movable plate comprises a third section, which is parallel to the first section, and the second section is arranged between the first section and the third section.

10. The sensor system for an underground mining vehicle according to claim 8, wherein the mounting plate comprises a perpendicular part, and the biasing member is arranged between the perpendicular part and the second section of the movable plate.

11. The sensor system for an underground mining vehicle according to claim 1, wherein the stand comprises guiding means for guiding the movement of the movable plate between the resting position and the retracted position.

12. The sensor system for an underground mining vehicle according to claim 11, wherein the guiding means comprises at least one elongated opening in the mounting plate, and fastening means for fastening the movable plate to the mounting plate, wherein the fastening means are configured to extend from the movable plate through the at least one elongated opening.

13. The sensor system for an underground mining vehicle according to claim 10, wherein the stand comprises guiding means for guiding the movement of the movable plate between the resting position and the retracted position, and wherein the guiding means comprises an elongated rod extending from the second section of the movable plate and a hole in the perpendicular part of the mounting plate, wherein the elongated rod extends from the second section through the hole in the perpendicular part.

14. The sensor system for an underground mining vehicle according to claim 1, wherein the movable plate, together with the guard member and the sensor fastened to the movable plate, is arranged to move towards the retracted position when the rim is subjected to an external force exceeding the biasing force of the biasing member.

15. An underground mining vehicle comprising a sensor system according to claim 1.

* * * * *